US006422386B1

(12) United States Patent
Wiese et al.

(10) Patent No.: US 6,422,386 B1
(45) Date of Patent: Jul. 23, 2002

(54) BLOW MOLDED DOUBLE WALL CHEST WITH PARTIAL FIXED TOP AND PARTIAL HINGED LID

(75) Inventors: James M. Wiese, Clinton, IA (US); Peter T. Schurman, New Canaan, CT (US)

(73) Assignee: Custom-Pak, Inc., Clinton, IA (US)

( * ) Notice: Subject to any disclaimer, the term of this patent is extended or adjusted under 35 U.S.C. 154(b) by 0 days.

(21) Appl. No.: 09/620,340

(22) Filed: Jul. 21, 2000

Related U.S. Application Data

(60) Provisional application No. 60/145,764, filed on Jul. 27, 1999.

(51) Int. Cl.[7] ..... B65D 85/00

(52) U.S. Cl. ..... 206/373; 220/840; 312/902

(58) Field of Search ..... 206/372, 373; 312/902; D3/294–296, 905; 220/834, 836, 840

(56) References Cited

U.S. PATENT DOCUMENTS

| | | | | | |
|---|---|---|---|---|---|
| 883,906 | A | * | 4/1908 | Swan | 206/373 |
| 3,301,619 | A | * | 1/1967 | Mead | 206/373 |
| 3,606,511 | A | * | 9/1971 | Henning et al. | 312/902 |
| 4,241,833 | A | * | 12/1980 | Luebcke | 206/373 |
| 4,470,517 | A | * | 9/1984 | Carrier | 220/840 |
| 4,768,651 | A | * | 9/1988 | Lanius | 206/373 |
| 4,775,199 | A | * | 10/1988 | Lanius et al. | 312/902 |
| 5,176,281 | A | * | 1/1993 | Fiore | 312/902 |
| 5,503,571 | A | * | 4/1996 | Cheslock | 206/373 |

* cited by examiner

*Primary Examiner*—Bryon P. Gehman
(74) *Attorney, Agent, or Firm*—St. Onge Steward Johnston & Reens LLC

(57) ABSTRACT

A blow molded carrying chest which includes a frame and a lid is provided. The frame includes a base frame member, and left and right end frame members attached to the base frame member. A top frame member is rigidly attached to the left and right end frame members, and defines only a portion of a top surface of the chest. A lid is hingedly connected to the frame, and defines a remainder of the top surface of the chest not defined by the top frame member. The lid is pivotable from a closed position to an open position to provide access to an interior of the chest. Preferably, the base frame member and the left and right end frame members are integrally molded as a single unit, and integrally molded hinges are provided between the base frame member and each of the left and right end frame members such that the left and right end frame members are pivoted with respect to the base frame member about the integrally molded hinges such that the left and right end frame members are substantially perpendicular to the base frame member. Also preferably, the top frame member includes, at each of two opposite ends thereof, a barbed portion, and the left and right end frame members include therein openings having stepped relief portions. The openings and stepped relief portions are sized and shaped to receive the barbed portions of the top frame member in a fixed snap fitted relationship.

19 Claims, 6 Drawing Sheets

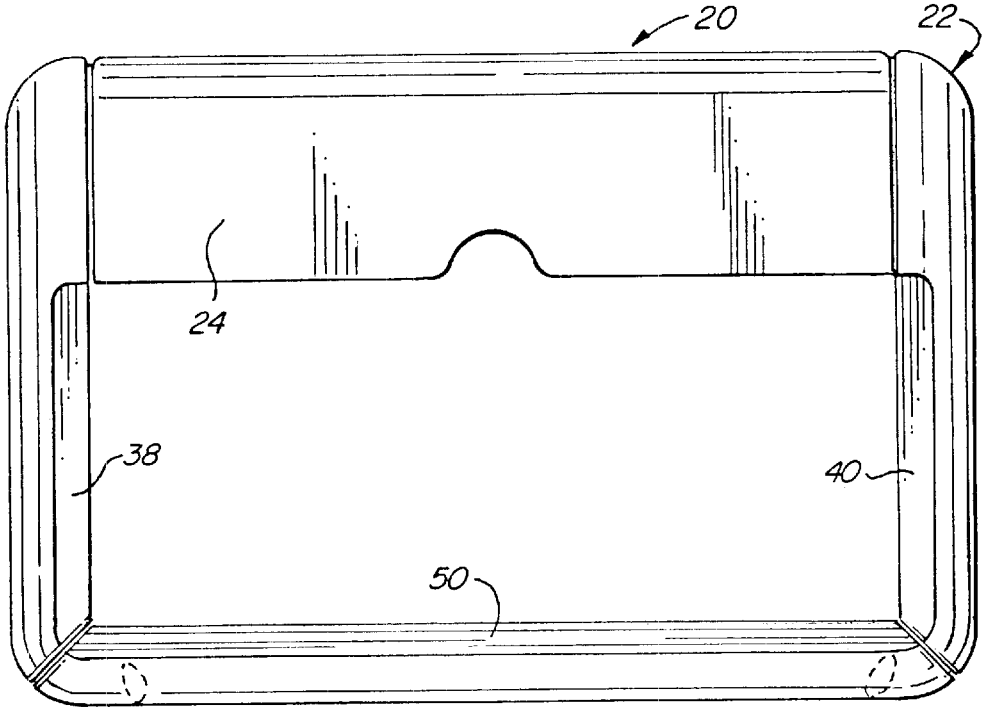
FIG. 5
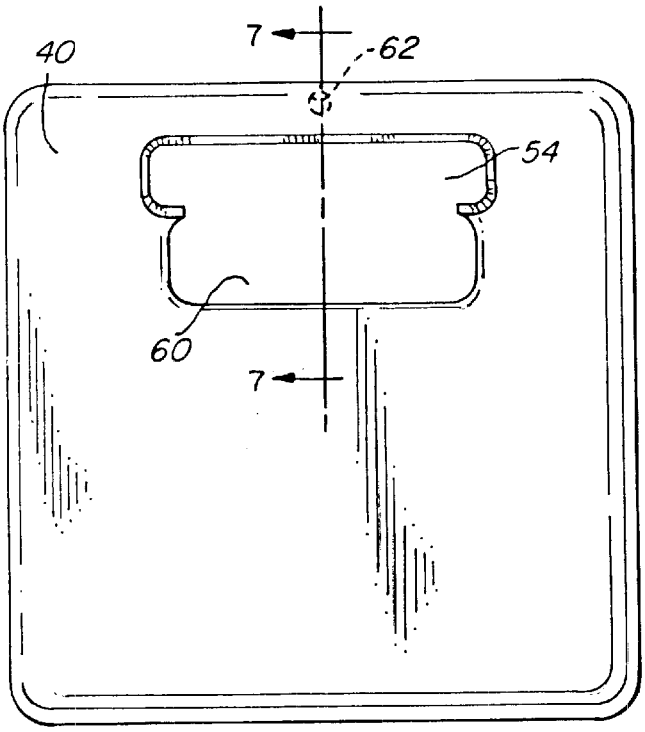
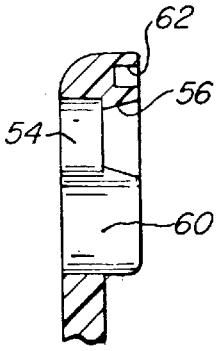
FIG. 7
FIG. 6

BLOW MOLDED DOUBLE WALL CHEST WITH PARTIAL FIXED TOP AND PARTIAL HINGED LID

CLAIM OF PRIORITY

The present application claims the benefit, under 35 U.S.C. 119(e), of U.S. Provisional Patent Application No. 60/145,764, filed Jul. 27, 1999.

FIELD OF THE INVENTION

The present invention relates to a carrying case or chest, and more particularly to a blow-molded double-walled carrying case or chest providing multiple layers of storage space.

BACKGROUND OF THE INVENTION

The blow molding of hinged, double wall carrying cases has been a proven commercial process since as early as 1964. Typically, such cases are integrally compartmented in their interiors to retain and position assortments of contents. Examples of such contents are power tools with accessories or multi-component instrument kits.

Requirements sometimes arise for the packaging in individual compartments of a relatively large number of separate objects of relatively small size or shallow depth, such as assortments of socket wrenches or taps and dies. If these assortments were organized in a single layer in the carrying case, the resultant package would be large and shallow. Such a case is relatively difficult to mold and awkward to carry and. store. To overcome these deficiencies, it is well known to design cases with a removable interior tray, the tray positioned over the compartments in the base of the case. Such a construction yields two layers of usable package surface. For a given contents assortment, this design substantially reduces the exterior area of the case, albeit with an increase in depth.

In certain circumstances a similar result can be achieved by molding individual compartments in the inside lid of the case as well as in the inside base. It is necessary that contents stored in these lid compartments be separated from those in the base. It is also necessary that they be retained in what is essentially an "upside down" position when the closed case rests on its bottom surface, or during the act of opening the hinged lid of the case. Sometimes this retention can be accomplished by snap fitting the lid contents in place. Usually, however, it is more desirable to install a separate, flat hinged panel in the inside lid, with a snap fit or other such closure opposite the hinges to hold the panel in a closed position, parallel to the lid parting line, as the case is opened or closed.

Both of the designs described above yield a package with two layers. However, there are situations in which more than two layers are desirable, either to enhance carrying or storage capabilities, or to satisfy marketing requirements for a distinctive package. Such multi-layer products usually consist of a series of drawers slidably mounted in a frame, that is to say, a storage chest. Such products are well known in plastic, wood or metal formats and they have been produced in double wall blow molded constructions. One such product is described in U.S. Pat. No. 4,662,515 and another was made commercially available as early as 1998 by Sears Roebuck & Co.

The chest of the '515 patent is formed by molding flat side and base members and then folding them into a frame which can receive sliding drawers. A box-like structure is attached to the top of the folded frame, and then a hinged lid is affixed to the top of the boxlike portion. This combination of a box with a hinged lid on top of a chest of sliding drawers permits packaging of contents of various depths and sizes in the box, and smaller, flatter contents in the drawers. However, the arrangement has at least three major deficiencies.

First, the assembly process is cumbersome and hence expensive. Second, the center carrying handle of the completed chest is mounted in the lid rather than in the frame. As a result, latches as well as hinges are required to secure the lid, and carrying stresses are imposed on the latches and hinges. This is undesirable because stresses on such components may lead to failure thereof under the weight of the chest's contents. Third, to mold the complete chest, both flat slabs (the frame) and the deeper box components are required. From a cost standpoint, it is advantageous to mold the complete chest frame as a single molding containing multiple cavities. However, combining deep and shallow parts in such a "family" mold introduces severe inefficiencies of production.

The Sears chests are produced as a series of flat panels which are then folded and snap fitted into a rigid frame. Molding becomes simpler because all components are flat and shallow. Assembly is also simplified by using snap fit attachment instead of a series of rivets or other separate fasteners. In addition, the center carrying handle of each Sears chest is mounted in the frame itself, thereby eliminating the need for latches or hinges, both of which mechanisms are subject to undesirable stress in a top-handle container.

However, in overcoming the deficiencies of the '515 chest, the Sears design introduces problems of its own. Using a full panel top means that all storage space in the chest will be in drawers and none in a boxlike structure. Moreover, top access, which is often desirable, is lost, along with a convenient means for accommodating contents of varying depths in a single compartment.

What is desired, therefore, is a blow molded double wall chest which is easy and inexpensive to produce relative to known designs, which includes a handle mounted in the frame rather than in a hinged lid, which includes molded components which are uniformly flat and shallow, which includes a portion thereof adapted to receive larger objects, and which provides for at least partial top access to objects stored therein.

SUMMARY OF THE INVENTION

Accordingly, it is an object of the present invention to provide a blow molded double wall chest which is easy and inexpensive to produce relative to known designs.

Another object of the present invention is to provide a blow molded double wall chest having the above characteristics and which includes a handle mounted in the frame rather than in a hinged lid.

A further object of the present invention is to provide a blow molded double wall chest having the above characteristics and which includes molded components which are uniformly flat and shallow.

Still another object of the present invention is to provide a blow molded double wall chest having the above characteristics and which includes a portion thereof adapted to receive larger objects.

Yet a further object of the present invention is to provide a blow molded double wall chest having the above characteristics and which provides for at least partial top access to objects stored therein.

These and other objects of the present invention are achieved by provision of a blow molded carrying chest which includes a frame and a lid. The frame includes a base frame member, a left end frame member and a right end frame member attached to the base frame member. A top frame member is rigidly attached to the left end frame member and the right end frame member, and defines only a portion of a top surface of the chest. A lid is hingedly connected to the frame, and defines a remainder of the top surface of the chest not defined by the top frame member. The lid is pivotable from a closed position to an open position to provide access to an interior of the chest.

Preferably, the base frame member, the left end frame member and the right end frame member are integrally molded as a single unit, and integrally molded hinges are provided between the base frame member and the left end frame member and between the base frame member and the right end frame member such that the left end frame member and the right end frame member are pivoted with respect to the base frame member about the integrally molded hinges such that the left end frame member and the right end frame member are substantially perpendicular to the base frame member. Also preferably, the top frame member includes, at each of two opposite ends thereof, a barbed portion, and the left end frame member and the right end frame member include therein openings having stepped relief portions. The openings and stepped relief portions are sized and shaped to receive the barbed portions of the top frame member in a fixed snap fitted relationship.

Preferably, the frame defines a drawer cavity and the chest includes a plurality of drawers slidably mounted within the drawer cavity such that each of the drawers is slidable between a retracted position wherein the drawer is located within the drawer cavity and an extended position wherein at least a portion of the drawer is protruding from the drawer cavity to provide access to contents of the drawer. Most preferably, the lid includes molded ribs on an inside surface thereof sized, shaped and positioned to retain contents of varying heights in position in a top of the plurality of drawers.

The lid, in addition to defining a remainder of the top surface of the chest not defined by the top frame member, is preferably curved downward toward the base frame member to also define at least a portion of a front surface of the chest and an edge defined by the top surface of the chest and the front surface of the chest. Preferably, a handle is attached to the top frame member to facilitate carrying of the chest.

Preferably, the base frame member defines a rectangular surface having portions thereof removed in order to reduce weight and bulk of the chest. Most preferably, the base frame member is hollowed out into a substantially C-shaped configuration in order to reduce weight and bulk of the chest with little sacrifice to rigidity.

The invention and its particular features and advantages will become more apparent from the following detailed description considered with reference to the accompanying drawings.

BRIEF DESCRIPTION OF THE DRAWINGS

FIG. 5 is a front plan view of the blow molded double wall chest of FIG. 1;

FIG. 6 is an end plan view of the right end of the blow molded double wall chest of FIG. 1;

FIG. 7 is a partially cross-sectional view of a portion of the blow molded double wall chest taken along 7—7 of FIG. 6;

DETAILED DESCRIPTION OF THE INVENTION

Figure 1:
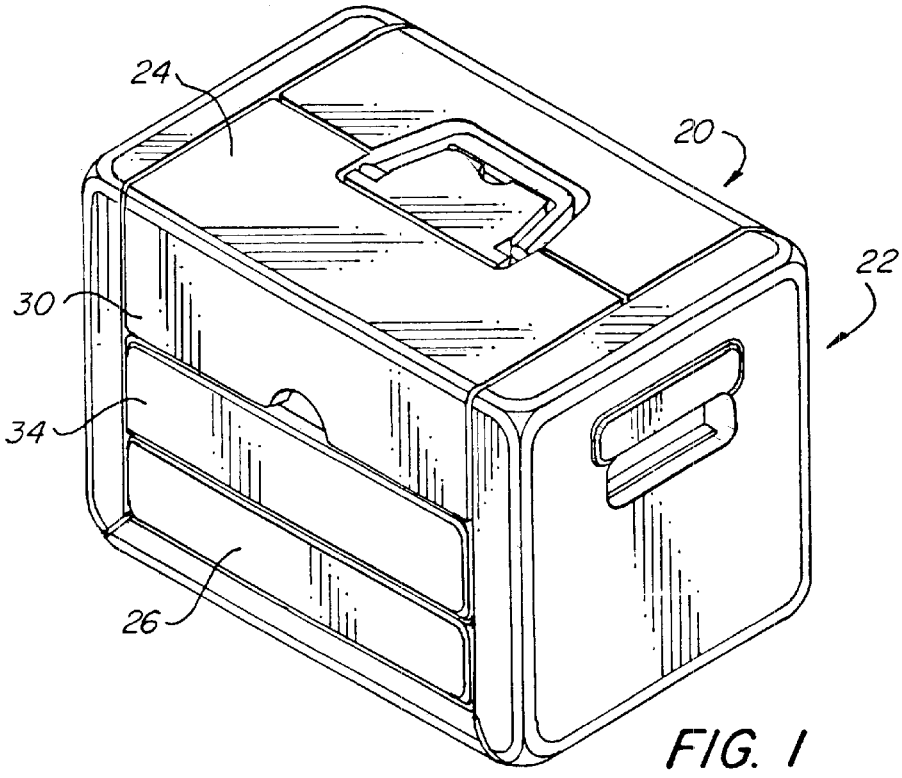
FIG. 1 is an isometric view of a blow molded double wall chest in accordance with the present invention.
Figure 2:
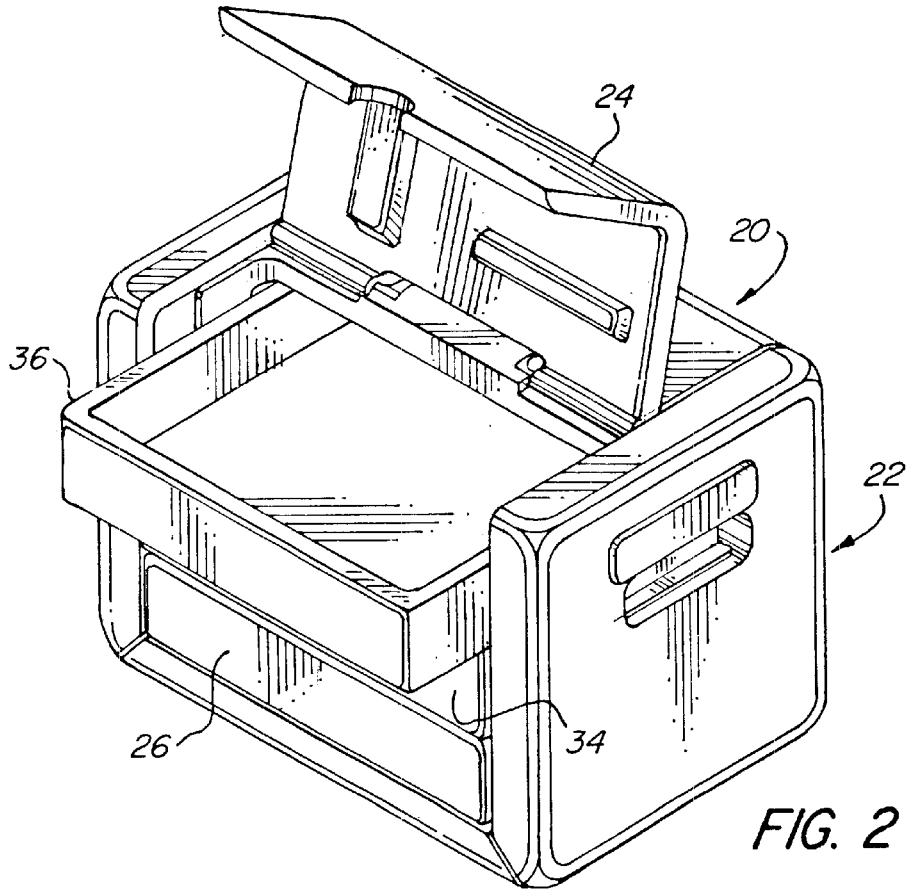
FIG. 2 is an isometric view of the blow molded double wall chest of FIG. 1 showing the hinged lid open and the top drawer extended.

Referring first to FIGS. 1 and 2, a blow molded double wall chest 20 in accordance with the present invention is shown. The chest 20 includes a frame 22 having a hinged lid 24 attached thereto, and a plurality of drawers 26. Lid 24 is hingedly attached to frame 22 such that lid 24 is movable between a closed position (shown in FIG. 1) and an open position (shown in FIG. 2). When in the closed position, lid 24 comprises a portion of a top surface 28 of chest 20 and a portion of a front surface 30 of chest 20, along with the upper front edge therebetween. Substantially the remainder of top surface 28 of chest 20 is comprised of a top frame member 32, which forms a portion of frame 22. Preferably, substantially the remainder of front surface 30 of chest 20 is comprised of the front faces 34 of drawers 26. As shown in FIG. 2, one or more of drawers 26 may comprise a hidden drawer 36, the front of which is covered by the portion of lid 24 which comprises a portion of the front surface 30 of chest 20.

Figure 3:
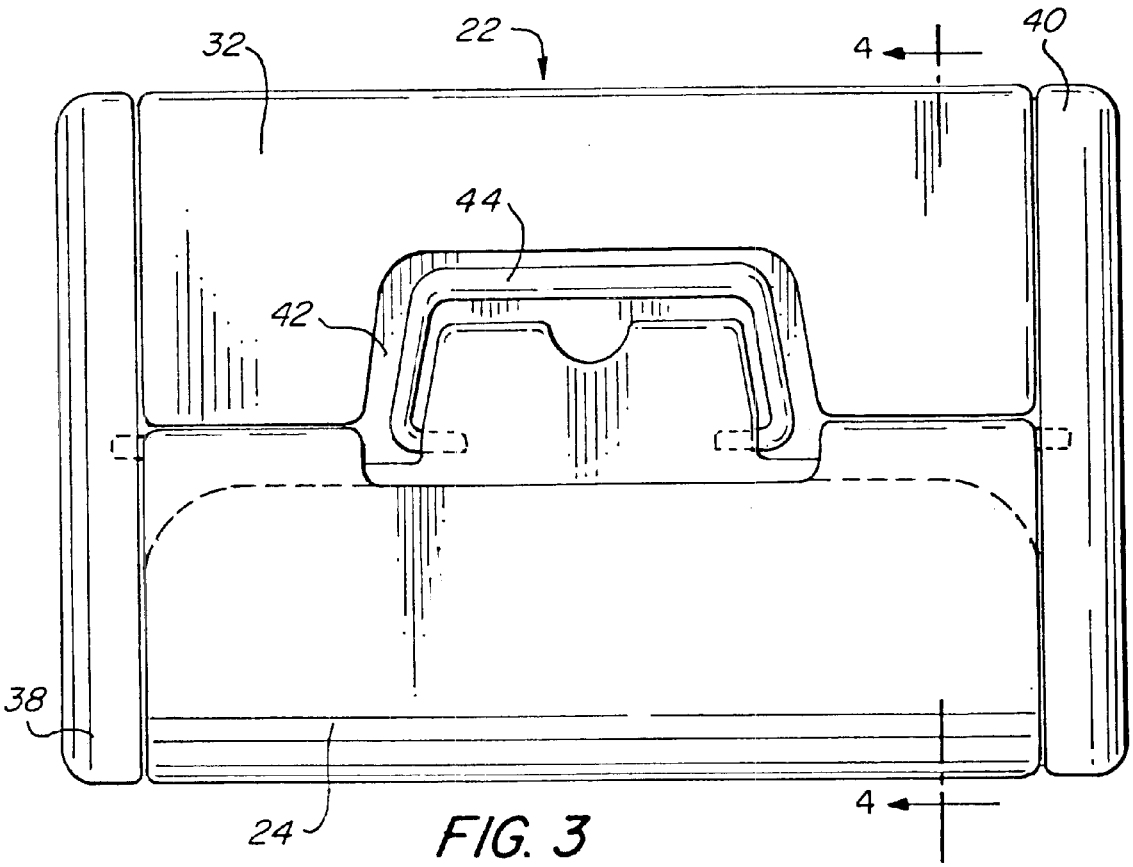
FIG. 3 is a top plan view of the blow molded double wall chest of FIG. 1.

Referring now to FIG. 3, in which a top plan view of chest 20 is shown, in addition to top frame member 32, frame 22 also comprises left end frame member 38 and right end frame member 40. Top frame member 32 preferably includes a handle recess 42 for receiving a handle 44, which is hingedly attached to top frame member 32, as discussed more fully below.

Figure 4:
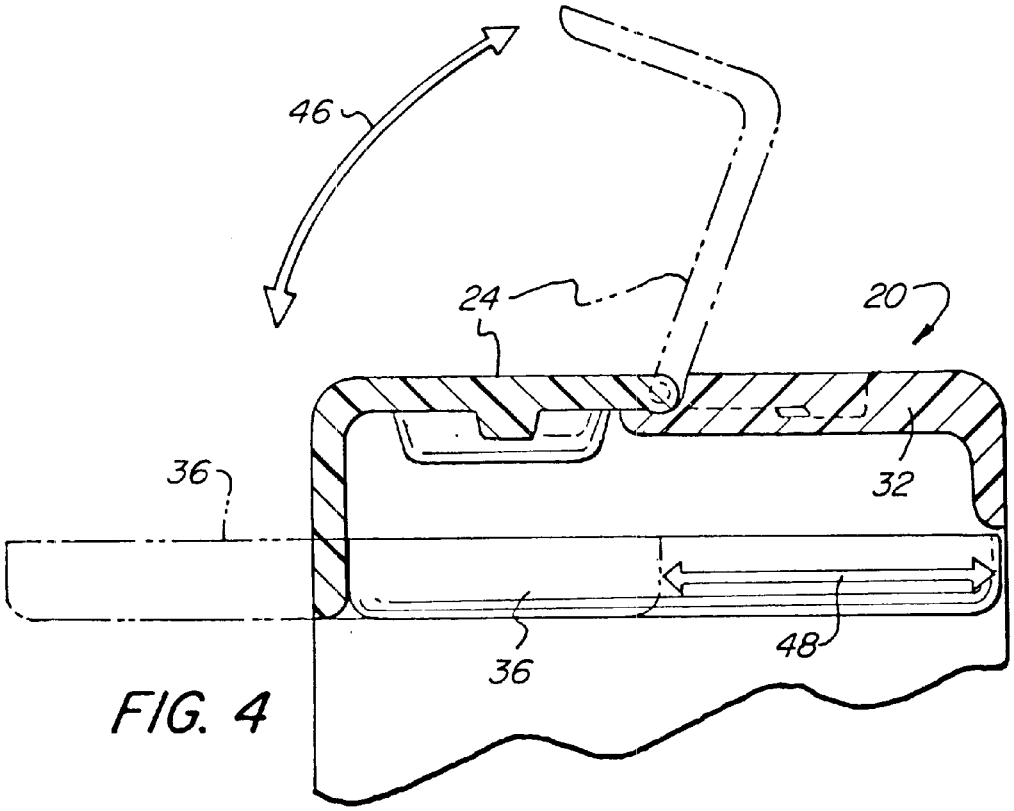
FIG. 4 is a partially cross-sectional view of a portion of the blow molded double wall chest taken along line 4—4 of FIG. 3.
Figure 10:
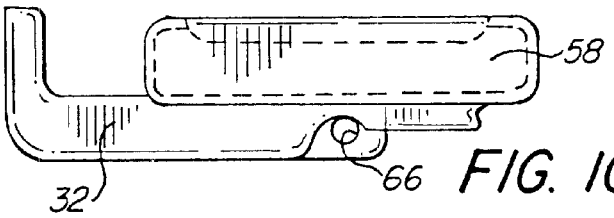
FIG. 10 is a view of the top frame portion of FIG. 8.

FIG. 4 shows a section of the upper portion of chest 20, taken on a vertical plane between the right edge of handle recess 42 and right frame end member 40. Hinged chest lid 24 is shown in the closed position (solid lines) and also in the open position (phantom lines). As indicated by arrow 46, lid 24 may be pivoted about its hinged connection with top frame member 32 between the open and closed positions. When lid 24 is in the closed position, hidden drawer 26 is in a retracted position and is located within frame 22 and lid 24. However, when lid 24 is in its open position, hidden drawer 28 may be slidably extended (indicated by arrow 48) to an extended position (indicated by dashed lines) for easier access to the contents of hidden drawer 28.

The chest 20 as illustrated in FIGS. 1–4 has three drawers 26. However, it should be noted that providing additional drawers or fewer drawers is contemplated and within the scope of the invention. Moreover, it should also be noted that the fashion in which drawers 26 are slidably mounted within chest 20 (i.e., drawer slide mechanisms) is not shown because these features are conventional and do not affect the present invention.

Referring now to FIG. 5, in which a front plan view of chest 20 is shown, in addition to top frame member 32, left end frame member 38 and right end frame member 40, frame 22 also comprises a base frame member 50, which is described more fully below. As shown, frame 22 and the members thereof define a drawer cavity 52 for receiving therein drawers 26 (not shown in FIG. 5).

Figure 8:
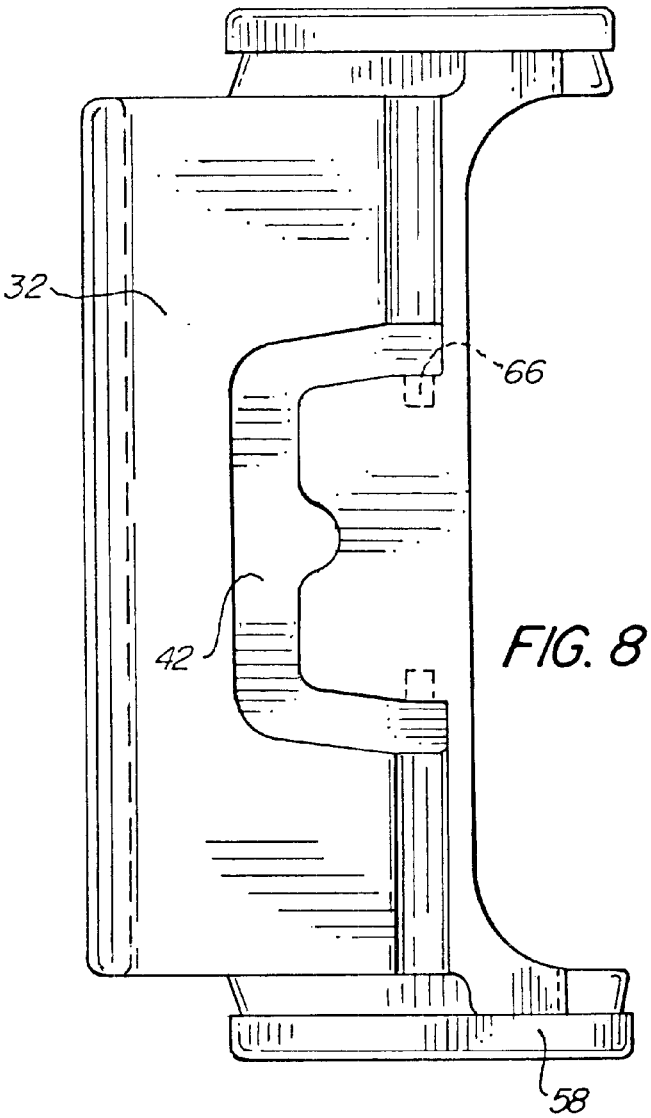
FIG. 8 is a top plan view of a top frame portion of the blow molded double wall chest of FIG. 1.
Figure 11:
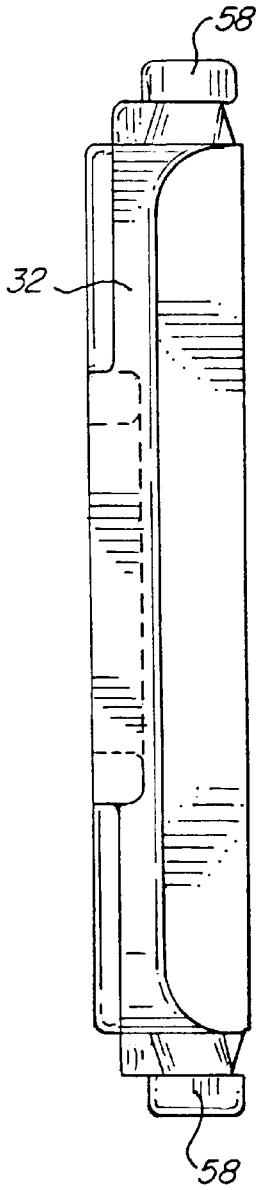
FIG. 11 is a front plan view of the top frame portion of FIG. 8.
Figure 9:
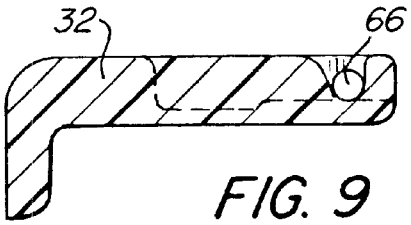
FIG. 9 is a partially cross-sectional view of the top frame portion taken along line 9—9 of FIG. 8.

Referring now to FIGS. 6 and 7, in which right end frame member 40 is shown, right end frame member 40 includes a first rectangular opening 54 pinched out in the interior thereof. As best seen in FIG. 7, first rectangular opening 54 includes a stepped relief portion 56 which is adapted to receive, in fixed engagement, a barbed end portion 58 (FIGS. 8 and 11) of top frame member 32, as described more fully below. Right end frame member 40 also includes a second rectangular opening 60 adjacent to first rectangular opening 54 pinched out in the interior thereof. Second rectangular opening 60 provides relief for a finger grip to facilitate carrying of chest 20 apart from handle 44. In addition, right end frame member 40 includes molded hinge receiving journal bearings 62, which are adapted to receive hinge lugs 64 of lid 24, as discussed more fully below. It should be understood that although only right end frame member 40 is shown, left end frame member 38 has an identical configuration in a mirror-image arrangement.

Referring now to FIGS. 8–11, top frame member 32 is shown in detail. Each end of top frame member 32 includes a barbed end portion 58 which is adapted to be fixedly snap fitted into first rectangular opening 54 molded through the top portion of left end frame member 38 and right end frame member 40, thereby forming a rigid, fixed top extending across the rear portion of top surface 28 of chest 20. As discussed above, top frame member 32 preferably includes a handle recess 42 for receiving a handle 44, which is hingedly attached to top frame member 32. Attachment of handle 44 to top frame member 32 may be accomplished by providing holes 66 in top frame member 32 adapted to receive corresponding lugs (not shown) on handle 44. The handle 44 will support a substantial weight of chest plus contents because of the direct and permanent mounting of the top frame member 32 to the left end frame member 38 and the right end frame member 40.

Figure 12:
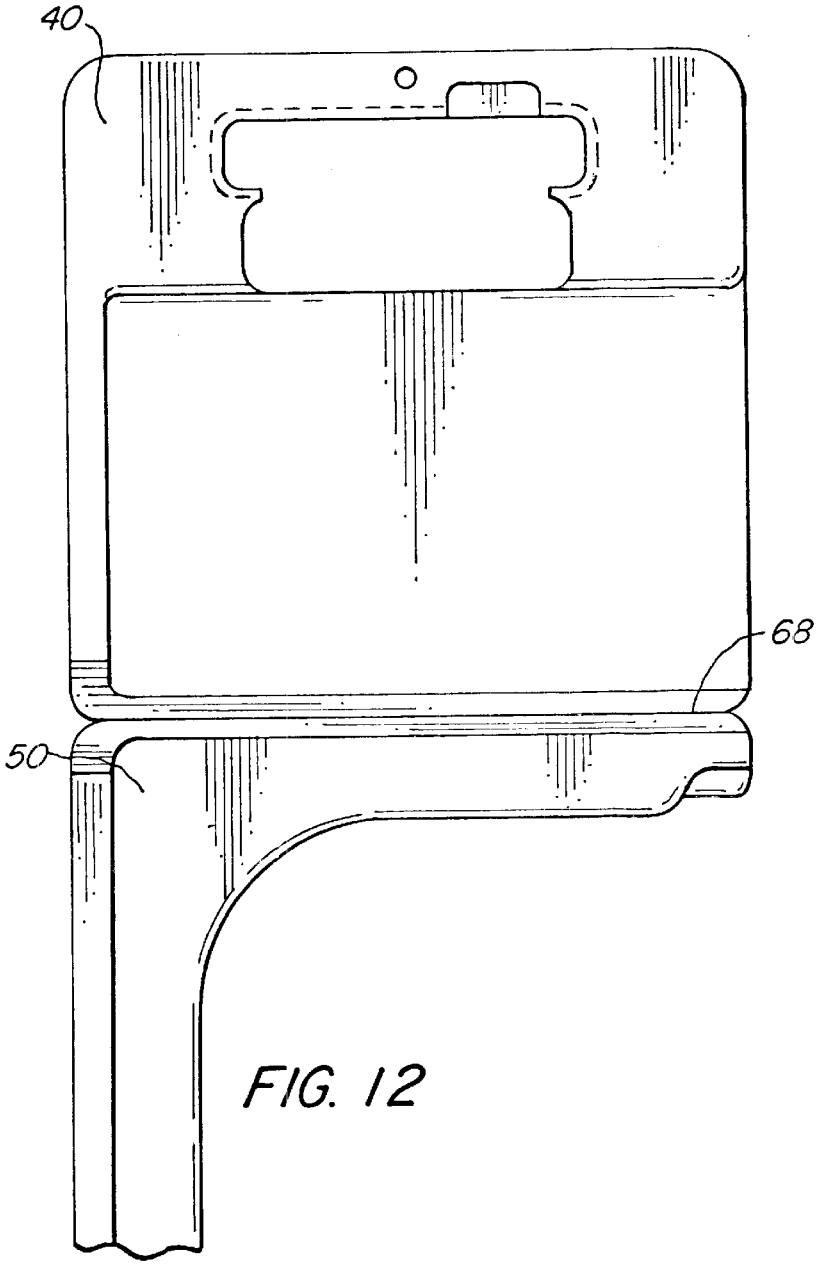
FIG. 12 is a plan view of the inside of left and right frame ends and the base frame of the blow molded double wall chest of FIG. 1 in flat position as they are molded.
Figure 13:
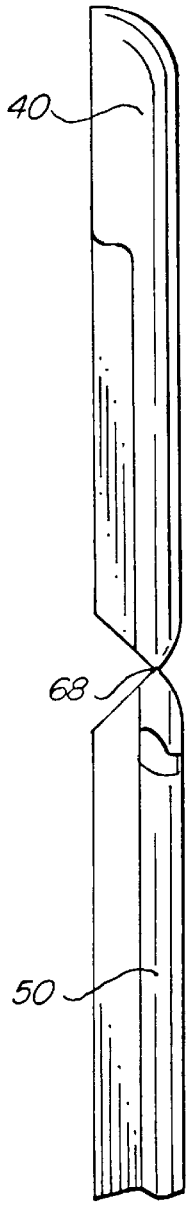
FIG. 13 is a plan view of the front edge of left and right frame ends and the base frame of FIG. 12.

Referring now to FIGS. 12 and 13, right frame end member 40 and the right half of base frame member 50, are shown in a flat position as they are molded, and connected by integral hinge 68 which permits folding right frame end member 40 substantially perpendicular to base frame member 50. The left half of base frame member 50 (not shown in FIGS. 12 and 13) and left frame end member 38 (also not shown in FIGS. 12 and 13) are in the mirror image of the right. Base frame member 50, as shown, is hollowed out into a "C" shaped configuration, which reduces both weight and bulk with little sacrifice of rigidity. Alternatively, the base could be molded as a solid rectangle, or a rectangle with the center removed for weight reduction.

In order to construct frame 22, left frame end member 38 and right frame end member 40 are folded about integral hinges 68 until they are almost perpendicular to base frame member 50. Top frame member 32 is then positioned such that barbed end portions 58 thereof align with first rectangular openings 54 of left frame end member 38 and right frame end member 40. Left frame end member 38 and right frame end member 40 are then folded about integral hinges 68 until they are substantially perpendicular to base frame member 50 and barbed end portions 58 of top frame member 32 are fixedly snap fitted into first rectangular openings 54 of left frame end member 38 and right frame end member 40. Alternately, one of barbed end portions 58 of top frame member 32 may be fixedly snap fitted into first rectangular opening 54 of left frame end member 38 or right frame end member 40, and then left frame end member 38 and right frame end member 40 folded about integral hinges 68 until the other barbed end portion 58 of top frame member 32 is fixedly snap fitted into the other of left frame end member 38 or right frame end member 40.

Figure 15:
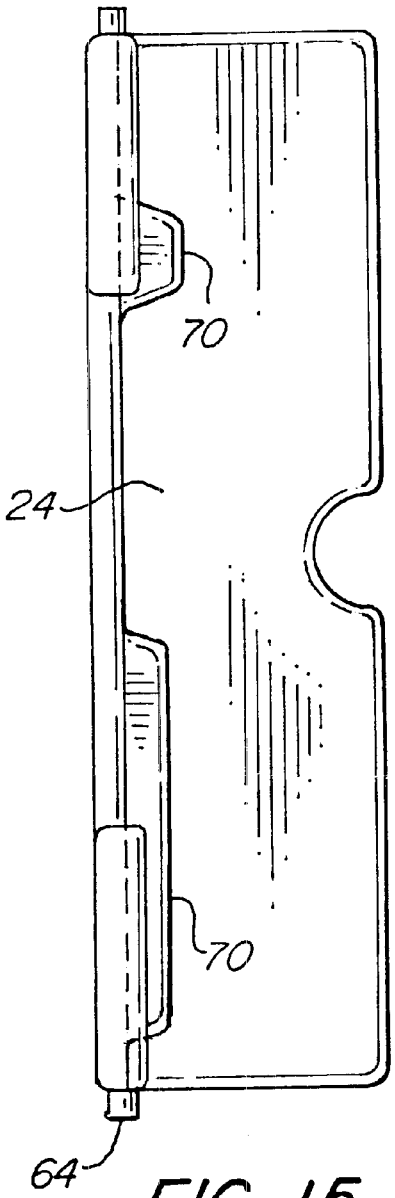
FIG. 15 i s an end plan view of the inside of the hinged lid of FIG. 14.
Figure 14:
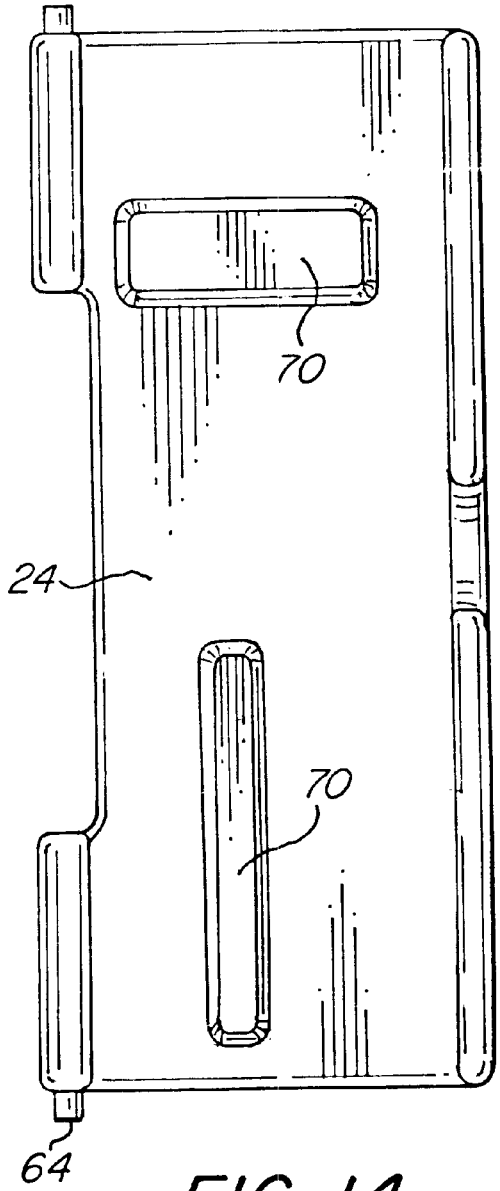
FIG. 14 is a bottom plan view of the inside of the hinged lid of the blow molded double wall chest of FIG. 1.

Referring now to FIGS. 14 and 15, the inside of hinged lid 24 is shown in detail. Hinged lid 24 includes hinge lugs 64 which are used to rotatably attach lid 24 to left frame end member 38 and right frame end member 40 by insertion into molded hinge receiving journal bearings 62 therein. Such attachment may be accomplished by aligning hinge lugs 64 with journal bearings 62 before left frame end member 38 and right frame end member 40 are fixedly joined in the manner described above. Preferably, lid 24 may also include molded ribs 70 which are sized, shaped and positioned to retain articles of varying heights in the top of drawers 26, whether such drawer comprises a hidden drawer 36 or a conventional drawer.

It should be understood that all of the major components of chest 20, namely, lid 24, drawers 26, top frame member 32, left end frame member 38, right end frame member 40, and base frame member 50 are produced by blow-molding, and have a double walled construction. As blow-molding is a well-known process known to those skilled in the art, the process is not described in detail herein.

From the forgoing description and illustrations it will be seen that the present invention provides numerous benefits over the prior art. As compared to a chest with a full hinged lid, the chest design of the present invention eliminates the need for latches to secure the lid while the chest is being carried by means of a top handle. In addition, the design of the present invention does not place any stress on the lid hinges while the chest is being carried. As compared to a chest with a full fixed lid, the design of the present invention provides a hinged lid which facilitates storage of contents of various depths. Moreover, the design of the present invention permits full access to the contents of the top drawer even when this drawer has been pulled forward to extend only half its width beyond the front edge of the chest frame. As compared to a chest with a boxlike top compartment, with four relatively deep side walls, the design of the present invention is produced from panels—either flat or "L" shaped in cross section—which are, in a molding sense, shallow. Restricting the design to such shallow components improves the efficiency of molds containing a plurality of different frame panels.

The present invention, therefore, provides a blow molded double wall chest which is easy and inexpensive to produce relative to known designs, which includes a handle mounted in the frame rather than in a hinged lid, which includes molded components which are uniformly flat and shallow, which includes a portion thereof adapted to receive larger objects, and which provides for at least partial top access to objects stored therein.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A blow molded carrying chest comprising:

a frame comprising:

a base frame member;

a left end frame member and a right end frame member attached to said base frame member; and a top frame member rigidly attached to said left end frame member and said right end frame member, said top frame member defining only a portion of a top surface of said chest;

wherein said base frame member, said left end frame member and said right end frame member are integrally molded as a single unit, and wherein said frame further comprises integrally molded hinges between said base frame member and said left end frame member and between said base frame member and said right end frame member such that said left end frame member and said right end frame member are pivoted with respect to said base frame member about the integrally molded hinges such that said left end frame member and said right end frame member are substantially perpendicular to said base frame member; and a lid hingedly connected to said frame, said lid defining a remainder of the top surface of said chest not defined by said top frame member, said lid pivotable from a closed position to an open position to provide access to an interior of said chest.

2. The blow molded carrying chest of claim 1 wherein said top frame member comprises, at each of two opposite ends thereof, a barbed portion, and wherein said left end frame member and said right end frame member include therein openings having stepped relief portions, the openings and stepped relief portions sized and shaped to receive the barbed portions of said top frame member in a fixed snap fitted relationship.

3. The blow molded carrying chest of claim 1 wherein said frame defines a drawer cavity, and further comprising a plurality of drawers slidably mounted within the drawer cavity such that each of the drawers is slidable between a retracted position wherein the drawer is located within the drawer cavity and an extended position wherein at least a portion of the drawer is protruding from the drawer cavity to provide access to contents of the drawer.

4. The blow molded carrying chest of claim 3 wherein said lid includes molded ribs on an inside surface thereof sized, shaped and positioned to retain contents of varying heights in position in a top of said plurality of drawers.

5. The blow molded carrying chest of claim 3 wherein said lid, in addition to defining a remainder of the top surface of said chest not defined by said top frame member, is curved downward toward said base frame member to also define at least a portion of a front surface of said chest and an edge defined by the top surface of said chest and the front surface of said chest.

6. The blow molded carrying chest of claim 1 further comprising a handle attached to said top frame member to facilitate carrying of said chest.

7. The blow molded carrying chest of claim 1 wherein said base frame member defines a rectangular surface having portions thereof removed in order to reduce weight and bulk of said chest.

8. The blow molded carrying chest of claim 7 wherein said base frame member is hollowed out into a substantially C-shaped configuration in order to reduce weight and bulk of said chest with little sacrifice to rigidity of said chest.

9. A blow molded carrying chest comprising:

a frame comprising:

a base frame member, a left end frame member and a right end frame member integrally molded as a single unit, and having integrally molded hinges between said base frame member and said left end frame member and between said base frame member and said right end frame member such that said left end frame member and said right end frame member are pivoted with respect to said base frame member about the integrally molded hinges such that said left end frame member and said right end frame member are substantially perpendicular to said base frame member, said left end frame member and said right end frame member having therein openings having stepped relief portions; and a top frame member having at each of two opposite ends thereof a barbed portion sized and shaped to fit within the openings of said left end frame member and said right end frame member in a fixed snap fitted relationship, said top frame member defining only a portion of a top surface of said chest; and a lid hingedly connected to said frame, said lid defining a remainder of the top surface of said chest not defined by said top frame member, said lid pivotable from a closed position to an open position to provide access to an interior of said chest.

10. The blow molded carrying chest of claim 9 wherein said frame defines a drawer cavity, and further comprising a plurality of drawers slidably mounted within the drawer cavity such that each of the drawers is slidable between a retracted position wherein the drawer is located within the drawer cavity and an extended position wherein at least a portion of the drawer is protruding from the drawer cavity to provide access to contents of the drawer.

11. The blow molded carrying chest of claim 10 wherein said lid includes molded ribs on an inside surface thereof sized, shaped and positioned to retain contents of varying heights in position in a top of said plurality of drawers.

12. The blow molded carrying chest of claim 9 wherein said lid, in addition to defining a remainder of the top surface of said chest not defined by said top frame member, is curved downward toward said base frame member to also define at least a portion of a front surface of said chest and an edge defined by the top surface of said chest and the front surface of said chest.

13. The blow molded carrying chest of claim 9 further comprising a handle attached to said top frame member to facilitate carrying of said chest.

14. The blow molded carrying chest of claim 9 wherein said base frame member defines a rectangular surface having portions thereof removed in order to reduce weight and bulk of said chest.

15. The blow molded carrying chest of claim 14 wherein said base frame member is hollowed out into a substantially C-shaped configuration in order to reduce weight and bulk of said chest with little sacrifice to rigidity of said chest.

16. A blow molded carrying chest comprising:

a frame defining a drawer cavity, said frame comprising:

a base frame member, a left end frame member and a right end frame member integrally molded as a single unit, and having integrally molded hinges between said base frame member and said left end frame member and between said base frame member and said right end frame member such that said left end frame member and said right end frame member are pivoted with respect to said base frame member about the integrally molded hinges such that said left end frame member and said right end frame member are substantially perpendicular to said base frame member, said left end frame member and said right end frame member having therein openings having stepped relief portions;

a top frame member having at each of two opposite ends thereof a barbed portion sized and shaped to fit within the openings of said left end frame member and said right end frame member in a fixed snap fitted relationship, said top frame member defining only a portion of a top surface of said chest; and a handle attached to said top frame member to facilitate carrying of said chest;

a lid hingedly connected to said frame, said lid defining a remainder of the top surface of said chest not defined by said top frame member and being curved downward toward said base frame member to also define at least a portion of a front surface of said chest and an edge defined by the top surface of said chest and the front surface of said chest, said lid pivotable from a closed position to an open position to provide access to an interior of said chest; and a plurality of drawers slidably mounted within the drawer cavity such that each of the drawers is slidable between a retracted position wherein the drawer is located within the drawer cavity and an extended position wherein at least a portion of the drawer is protruding from the drawer cavity to provide access to contents of the drawer.

17. The blow molded carrying chest of claim 16 wherein said lid includes molded ribs on an inside surface thereof sized, shaped and positioned to retain contents of varying heights in position in a top of said plurality of drawers.

18. The blow molded carrying chest of claim 16 wherein said base frame member defines a rectangular surface having portions thereof removed in order to reduce weight and bulk of said chest.

19. The blow molded carrying chest of claim 18 wherein said base frame member is hollowed out into a substantially C-shaped configuration in order to reduce weight and bulk of said chest with little sacrifice to rigidity of said chest.

* * * * *

UNITED STATES PATENT AND TRADEMARK OFFICE
Certificate

Patent No. 6,422,386 B1 Patented: July 23, 2002

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: James M. Wiese, Clinton, IA; Peter T. Segurman, New Canaan, CT; and Patrick T. Jones, Fulton, IL.

Signed and Sealed this Nineteenth Day of November 2002.

JOHN G. WEISS
*Supervisory Patent Examiner*
Art Unit 3629